US008864503B2

(12) United States Patent
Charpentier et al.

(10) Patent No.: US 8,864,503 B2
(45) Date of Patent: Oct. 21, 2014

(54) BIASING CONNECTOR

(75) Inventors: Didier Charpentier, Milan (IT); Thierry Charpentier, Milan (IT); Stephane Tognali, Milan (IT)

(73) Assignee: Prysmian S.p.A., Milan (IT)

( * ) Notice: Subject to any disclaimer, the term of this patent is extended or adjusted under 35 U.S.C. 154(b) by 93 days.

(21) Appl. No.: 13/514,853

(22) PCT Filed: Dec. 10, 2009

(86) PCT No.: PCT/EP2009/066810

§ 371 (c)(1), (2), (4) Date: Aug. 9, 2012

(87) PCT Pub. No.: WO2011/069547

PCT Pub. Date: Jun. 16, 2011

(65) Prior Publication Data

US 2012/0322303 A1 Dec. 20, 2012

(51) Int. Cl.

| | |
|---|---|
| ***H01R 4/66*** | (2006.01) |
| ***H01R 9/05*** | (2006.01) |
| *H01R 4/18* | (2006.01) |

(52) U.S. Cl.

CPC ..... *H01R 9/0518* (2013.01); *H01R 4/188* (2013.01)

USPC ..... 439/98

(58) Field of Classification Search

USPC ..... 439/98, 100, 99, 578, 432; 174/36, 78, 174/88 R, 51

See application file for complete search history.

(56) References Cited

U.S. PATENT DOCUMENTS

| | | | | | |
|---|---|---|---|---|---|
| 759,414 | A | * | 5/1904 | Bishop | 439/432 |
| 3,537,060 | A | * | 10/1970 | Tordoff | 439/100 |
| 3,728,472 | A | * | 4/1973 | Leuteritz et al. | 174/78 |
| RE28,837 | E | * | 6/1976 | Silva | 174/78 |
| 4,080,024 | A | * | 3/1978 | Kroon | 439/98 |
| 4,383,131 | A | * | 5/1983 | Clabburn | 174/73.1 |
| 4,696,649 | A | * | 9/1987 | Smorzaniuk et al. | 439/98 |
| 5,028,742 | A | * | 7/1991 | Redman | 174/88 R |

(Continued)

FOREIGN PATENT DOCUMENTS

| | | |
|---|---|---|
| DE | 296 14 957 U1 | 1/1997 |
| EP | 0 450 838 A1 | 10/1991 |

(Continued)

OTHER PUBLICATIONS

International Search Report.

(Continued)

*Primary Examiner* — Alexander Gilman

(74) *Attorney, Agent, or Firm* — Harness, Dickey & Pierce PLC

(57) ABSTRACT

A biasing connector for biasing a shielding element of a power cable in connection with a cable joint, wherein an external sheath extends over a length of a cable sheath, may include an end portion configured to contact the shielding element and a conductive tape having a first end, connected to the end portion of the biasing connector, and a second end, configured to connect to a terminal providing a biasing voltage. At least one portion of the conductive tape may include at least one layer of a solid flat element having a width substantially equal to a transversal width of the conductive tape. The at least one portion of the conductive tape may be at least partly covered by the external sheath.

20 Claims, 5 Drawing Sheets

(56) References Cited

U.S. PATENT DOCUMENTS

| | | | | | |
|---|---|---|---|---|---|
| 5,315,063 | A | * | 5/1994 | Auclair | 174/78 |
| 5,418,330 | A | * | 5/1995 | Rook | 174/78 |
| 5,473,117 | A | * | 12/1995 | Morgan et al. | 174/78 |
| 5,631,444 | A | * | 5/1997 | Rook | 174/78 |
| 5,646,370 | A | * | 7/1997 | Perkins | 174/51 |
| 5,722,841 | A | | 3/1998 | Wright | |
| 5,726,389 | A | * | 3/1998 | Hogeveen et al. | 174/78 |
| 6,545,220 | B2 | * | 4/2003 | Syed et al. | 174/75 C |
| 7,373,054 | B2 | * | 5/2008 | Stix et al. | 385/100 |

FOREIGN PATENT DOCUMENTS

| | | | |
|---|---|---|---|
| EP | 0732768 | A1 | 9/1996 |
| FR | 2271688 | A1 | 12/1975 |
| FR | 2 446 023 | A1 | 8/1980 |
| GB | 2349019 | A | 10/2000 |

OTHER PUBLICATIONS

European Office Action dated Mar. 4, 2014, issued in corresponding EP Application No. 09 799 588.0-1801.

* cited by examiner

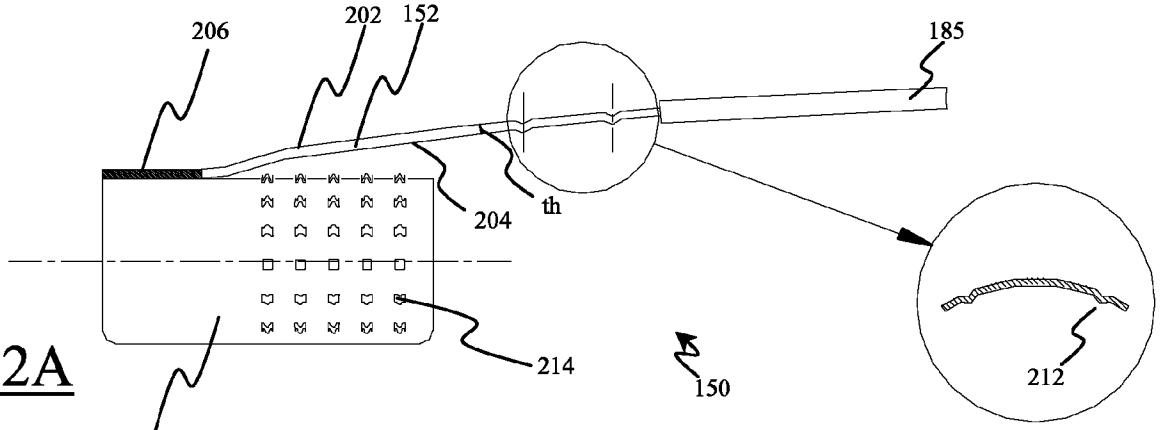
FIG.2A
FIG.2C
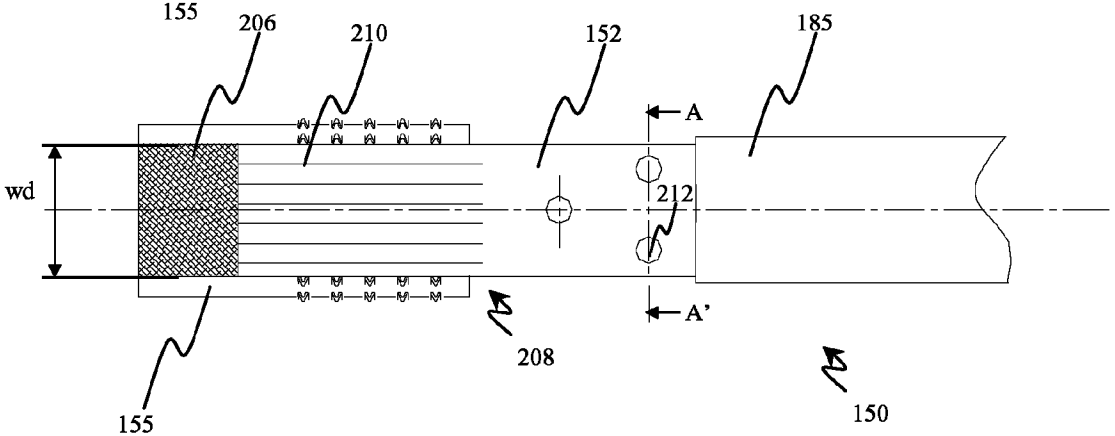
FIG.2B

BIASING CONNECTOR

CROSS-REFERENCE TO RELATED APPLICATION(S)

This application is a national stage entry from International Application No. PCT/EP2009/066810, filed on Dec. 10, 2009, in the Receiving Office of the European Patent Office, the entire contents of which are incorporated herein by reference.

FIELD OF THE INVENTION

The present invention relates to the field of the electric power cables. Particularly, the present invention relates to connection devices for power cables.

BACKGROUND OF THE INVENTION

Generally speaking, with the term "Medium Voltages" (briefly, MV) it is intended a range of voltages of the order of the tens of KVolts. For example, the MV range may extend from 1 KVolts to 52 KVolts.

Usually, the power cables used for conveying or supplying electrical power at these voltage levels comprise a plurality of components. Starting from the inside of the cable and proceeding toward the outside thereof, a power cable typically includes a metal conductor, an inner semiconductive layer, an insulating layer, an outer semiconductive layer, a metal screen—usually made of aluminum, lead or copper—and an external—typically, polymeric—cable sheath.

The structure, the material and the size of these components vary according to the particular application for which the power cable is intended and the expected environmental conditions to which the cable is subjected. For example, the cross-sectional size of the metal conductor is mainly determined by the current-carrying capacity of the cable, the thickness of the semiconductive and insulating layers is mainly determined by the value of the working voltage, while the shape and composition of the cable sheath is mainly determined by the environmental conditions to which the cable is subjected.

When two cable lengths have to be joined together, a construction usually called "cable joint" is provided, to get the electric connection and to restore the insulation and protection of the cable.

The discussion below is made with specific reference to cable joints, but it can apply to other conditions, such as cable terminations, where similar problems arise. Moreover, even if reference will be made to power cables for medium voltage applications, similar considerations apply to power cables designed for operating within different voltage ranges, such as those corresponding to low and high voltage applications.

For the purposes of the present invention, by "cable joint" term is meant any circumstance, in which the cable sheath and possibly underlying layers are exposed to provide access to the parts of the cable construction, such in cable connection assembly as cable joints, cable terminations, branch cable joints, stop-ends and the like. The assembly is used to restore properties of the electrical line, said assembly, in particular, including an external sheath to be applied over the area of removal of the cable sheath.

In the following, unless differently specific, the term "cable joint" is meant to encompass also these other components showing the same problems and getting benefit from the same solution.

In order to connect the ends of two power cables for establishing a common electrical connection, such ends are firstly processed so as to expose, over a portion of defined length, each one of the components forming both the cables. Then, the exposed metal conductors of the two power cables are connected to each other, for example through soldering or by means of a suitable metallic clamp.

In order to restore the continuity among the other components of the two cables, a suitable joint element is positioned on the zone wherein the metal conductors are connected. Usually, a joint element of this type comprises a sleeve element adapted to be fitted on the two ends of the power cables. Such sleeve element has a generally cylindrical central portion, with two frustoconical ends.

The sleeve element comprises a plurality of superimposed layers. For example, a typical sleeve element may comprise a stress control layer made of material with a high dielectric constant, an insulating layer of insulating material covering the stress control layer, and a layer of semiconductive material covering the insulating layer.

A sleeve element of the so-called cold-retractable type is generally supplied fitted, in an elastically-dilated condition, on a hollow tubular support made of rigid plastic material. Such tubular-supported sleeve element is fitted on one of the two power cables before the formation of the connection between the metal conductors.

The tubular support may be made using different methods which allow the removal thereof once the sleeve element has been correctly positioned. For example, the tubular support may be made in the form of a helix so that, when a pulling force is exerted on a free end portion of said strip-like element, the tubular support is caused to collapse over the cable ends. In so doing, the sleeve element elastically contracts, clamping over the cable sections in the joining zone.

Sleeve elements of the so-called heat-shrinkable type are also known, which are formed by heat-shrinkable materials.

Other types of sleeve elements are known, such as the so-called slip-on sleeves (formed by pre-molded components fitted on the cables using proper lubricants), the so-called taped sleeves (whose components are assembled using insulating, semiconductive and/or high permittivity tapes), and the resin-based sleeves.

A joint element typically further comprises a joint shield configured to restore the metal screen over the portions of the two power cables which have been exposed. For example, a tin-plated copper strip may be applied starting from the exposed metal screen portion of the first cable and ending on the exposed metal screen of the second cable.

In the case where the joining operation is performed between two sections of electrical cable of the multi-pole-for example double-pole or triple-pole type, the procedure described hitherto is repeated for each single phase of each cable.

Usually, a joint element as defined above further comprises an external sheath suitable for restoring over the exposed portions of the two power cables the mechanical protection offered by the external cable sheaths. Such external sheath of the joint is usually made of a polymeric material and is fitted on the outside surface of the joint shield, so as to protect the underlying layers from coming into contact with the outer environment (e.g., moisture and/or water, etc. . . . ).

Preferably, the joint shield is usually biased to the ground voltage through a proper biasing connector and attached to a surface of the exposed metal screen portion of one of the two cables. Since such exposed metal screen is electrically connected to the joint shield, by grounding the exposed metal screen portion of a cable through such biasing connector, the joint shield itself results to be accordingly grounded.

Known biasing connectors generally comprise a conductive tape connected to an end portion configured to allow the biasing connector to be firmly fixed on the exposed metal screen of one of the power cables; for example, such end portion is adapted to mechanically cooperate with a surface of the metal screen by applying a radial tightening thereto. The conductive tape is made of a braid of woven metallic wires, usually made of tinned copper, which extends from a first end soldered to the end portion to a second end comprising a socket connector adapted to be fastened to a terminal providing the ground voltage. In this way, the joint shield can be grounded through the conductive path formed by the conductive tape, the end portion and the metal screen of the cable.

The use of the conductive tape made of a braid of woven metallic wires has been considered important because its flexibility allowed the tape to mate precisely with the surface of the cable sheath, thereby minimizing the deformation of the external sheath, possible source of water penetration.

In order to prevent the occurrence of mechanical faults in the conductive tapes and for increasing the operative life thereof, particular care has to be employed for protecting the braid of woven metallic wires from possible water and humidity infiltrations.

Moreover, since the conductive tape of the biasing connector has to pass between the external sheath of the joint element and the cable sheath, in order to be capable of reaching the terminal providing the ground element, particular care has also to be employed for avoiding that water and humidity infiltrate within the interior of the joint element through such opening.

For these purposes, the water and humidity resistance of the conductive tape and of the joint element is improved by coating the conductive tape that protrudes out of the joint element with a proper protective sheath. Generally said protective sheath covers both the two surfaces of the braid of woven metallic wires of the conductive tape.

SUMMARY OF THE INVENTION

The Applicant observes that the known biasing connectors adapted to bias the metal screen of a power cable to the ground voltage or other potential do not offer a sufficient protection against water and humidity. Particularly, the Applicant has observed that the braid nature of the known conductive tape implies surface irregularities of the conductive tape itself, and such irregularities behaves as channels through which water, humidity, and/or other substances, can penetrate. Tinning the woven wires of the braid forming the conductive plate so as to make the conductive tape surface as smooth as possible has been considered, but it turns out to be very critical operation, since it is really difficult to correctly tin a tape having a braid structure—especially the center portion thereof. An incorrect tinning operation may imply the presence of some small open paths in the braid, through which water and humidity may infiltrate, damaging the metallic wires of the biasing connector. Furthermore, through such open paths the water and humidity may also reach the interior of the joint element, damaging all the conductive parts thereof as well as the conductive parts of the power cables coupled therewith.

According to a first aspect, the present invention relates to a biasing connector for biasing a shielding element of a power cable in connection with a cable joint, wherein an external sheath extends over a length of a cable sheath, the biasing connector including: an end portion for contacting the shielding element, and a conductive tape having a first end connected to the end portion of the biasing connector and a second end adapted to be connected to a terminal providing a biasing voltage, wherein at least a portion of the conductive tape comprises at least one layer of a solid flat element having a width substantially equal to a transversal width of the conductive tape, said at least one portion being at least partly covered by the external sheath.

Preferably said shielding element is a metal screen of said power cable.

Alternatively said shielding element is a semiconductive layer of said power cable.

Alternatively said biasing connector is adapted to bias a portion of said semiconductive layer and a portion of metal screen, both of said power cable.

Advantageously a protective sheath covers at least part of said conductive tape of said biasing connector.

Preferably said at least one portion comprising the at least one layer of a solid flat element of said biasing connector includes the second end.

More preferably said at least one portion comprising the at least one layer of a solid flat element of said biasing connector includes the first end.

Preferably said conductive tape includes a first braid-of-woven-wires portion connected to the end portion and/or a second braid-of-woven-wires portion connected between said at least one layer of a solid flat element and the second end.

Preferably at least one portion of the conductive tape of the biasing connector is made of copper.

More preferably at least one portion of the conductive tape of the biasing connector is made of tinned copper.

Preferably, each one among the at least one layer comprised in the at least one portion of the conductive tape of the biasing connector includes a top main surface and a bottom main surface that are substantially smooth.

More preferably each one among the at least one layer comprised in said at least one portion of the conductive tape includes at least one protrusion projecting from the bottom main surface.

Advantageously, in place of or in addition to the protrusion projecting from the bottom main surface, each one among the at least one layer comprised in said at least one portion of the conductive tape includes at least one protrusion projecting from the top main surface.

Preferably the conductive tape of said biasing connector is provided with a set of longitudinal cuts in the proximity of the first end.

Preferably the end portion of the biasing connector comprises a clamping element including a warped sheet of metallic material adapted to mechanically cooperate with the shielding element.

More preferably said warped sheet comprises a plurality of protruding elements.

Preferably, the end portion is a portion integral to the conductive tape adapted to be fastened to the shielding element by means of a fastening element.

Such fastening element may be a metallic wire, a spring element or a soldering.

Preferably the second end of the biasing connector includes a socket connector adapted to be connected to the terminal by means of a plug element.

According to a further aspect, the present invention regards a power cable connection assembly comprising a biasing connector configured to be coupled to a shielding element of a power cable, the biasing connector including an end portion for contacting the shielding element, and a conductive tape having a first end connected to the end portion and a second end adapted to be connected to a terminal providing a biasing voltage, the power cable connection accessory further including an external sheath extending over a length of a cable sheath, wherein at least one portion of the conductive tape comprises at least one layer made of a solid flat element having a width substantially equal to a transversal width of the conductive tape, said at least one portion being at least partly covered by the external sheath.

For the purposes of the present invention, by the term "power cable connection assembly" is meant a joint element adapted to electrically connect a power cable to a further power cable, such a power cable connector, a power cable termination, a branch power cable joint and the like.

BRIEF DESCRIPTION OF THE DRAWINGS

These and other features and advantages of the present invention will be best understood by reading the following detailed description of some embodiments thereof, to be read in conjunction with the accompanying drawings, wherein:

FIG. 2A is a side view of a biasing connector according to a first embodiment of the present invention;

FIG. 2B is a top view of the biasing connector of FIG. 2A;

FIG. 2C is a sectional view of the biasing connector of FIGS. 2A and 2B;

DETAILED DESCRIPTION

Figure 1:
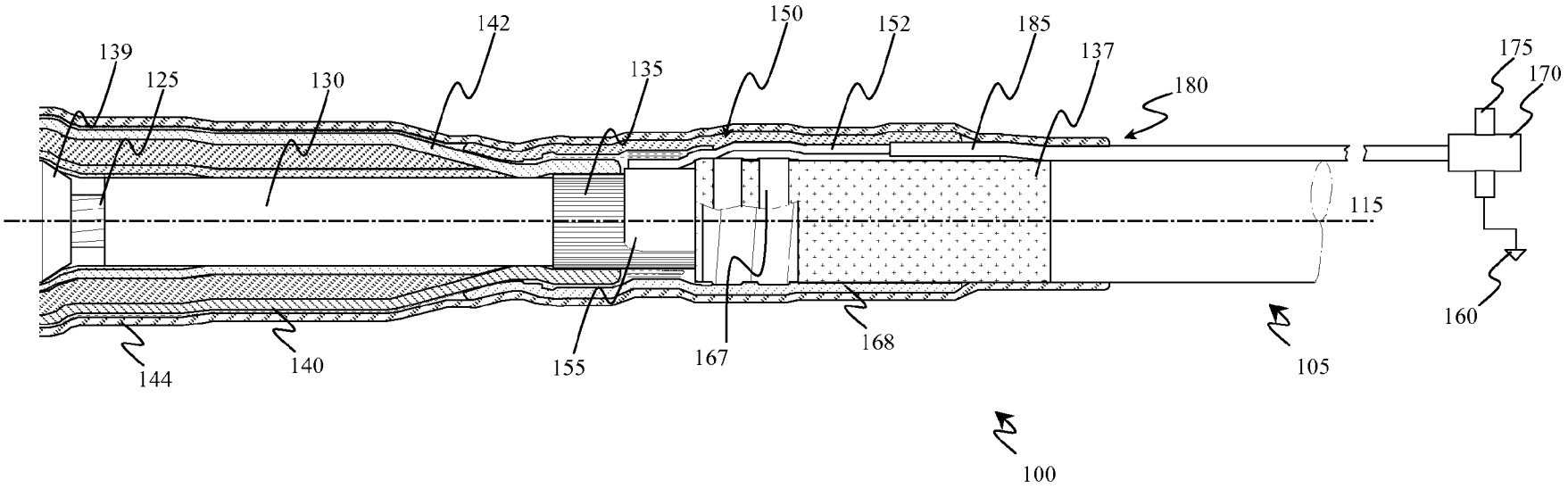
FIG. 1 illustrates a possible application of a biasing connector according to an embodiment of the present invention.

With reference to the drawings, FIG. 1 illustrates a possible application of a biasing connector according to an embodiment of the present invention.

FIG. 1 illustrates a longitudinal sectional view of a portion of an exemplary joint element 100 fitted on linked ends of two MV power cables. FIG. 1 shows only one of such two MV power cables, which is identified with the reference 105. The longitudinal sectional view of FIG. 1 is taken along a plane passing through the longitudinal axis of symmetry of the joint element 100, identified in the figure with the reference 115. The longitudinal axis of symmetry of the power cable 105 coincides with the longitudinal axis 115.

The power cable 105 comprises a metal conductor 125, an insulating layer 130, a semiconductive layer 135, a metal screen (not shown in the figure) and a cable sheath 137.

Said semiconductive layer 135 and said metal screen represent a shielding element and they can be present together or individually. Generally the shielding element protects the cable from electromagnetic field generated by the conductive elements when crossed by current.

As already mentioned, some of the components of the power cable 105 in the end thereof are exposed over corresponding portions of defined lengths.

Particularly, an exposed portion of the metal conductor 125 is fitted in a metallic clamp 139 configured to establish a mechanical and electrical connection with a corresponding exposed portion of the metal conductor of the other power cable (not shown in the figure). The remaining portion of the metal conductor 125 is instead covered by the insulating layer 130; the insulating layer 130 has in turn a first exposed portion and a second portion that is covered by the semiconductive layer 135. As can be seen in the figure, the metal conductor 125 and the insulating layer 130 have the exposed portions which are in longitudinal succession, starting from the end of the power cable 105 fitted in the metallic clamp 139 and proceeding along the longitudinal axis 115 toward the other end of the same power cable 105 (not shown in the figure). Proceeding along the longitudinal axis, the semiconductive layer 135 has a first exposed portion and a second portion which is covered by the metal screen. The metal screen covering the semiconductive layer 135 is not visible in FIG. 1, since in the considered example the metal screen is entirely covered by the cable sheath 137 (for example, the metal screen may be a metallic layer having a thickness of about 150-200 μm that is attached to the internal surface of the cable sheath 137); however, similar considerations apply in case the cable sheath 137 is such to left exposed a portion of the underlying metal screen.

The joint element 100 includes a sleeve element, globally identified with the reference 140, having a plurality of superimposed layers. Without entering into details well known to the skilled technicians, the sleeve element 140 comprises a stress control layer made of material having a high dielectric constant, an insulating layer of insulating material covering the stress control layer, and a layer of semiconductive material covering the insulating layer.

To the joint element 100 is further associated with a joint shield—identified in the figure with the reference 142—covering the sleeve element 140 and contacting the metal screen of the power cable 105. An external sheath 144 adapted to ensure mechanical protection and watertightness covers the joint shield 142 and the sleeve element of the joint element 100 as well as the end of the power cable 105.

A biasing connector 150 adapted to be connected to a terminal 160 providing the ground voltage for the grounding of the metal screen of the power cable is provided. The biasing connector 150 includes a flexible conductive tape 152 for the electrical connection to the terminal 160 and an end portion connected to the conductive tape 152 for contacting the metal screen of the power cable 105.

According to an embodiment of the present invention the end portion is a clamping element (identified in the figure with the reference 155) that, when installed, is positioned astride a portion of the exposed semiconductive layer 135 and a portion (covered by the cable sheath 137) of the metal screen of the power cable 105. Particularly, the clamping element 155 is made of a warped sheet of metallic material, such as steel, having a curvature such that it mechanically cooperates with the outer surface of the semiconductive layer 135 and the metal screen by applying a radial tightening when located astride the semiconductive layer 135 and the metal screen. A portion (not visible in figure) of the clamping element 155 is inserted under the cable sheath 137 for directly contacting the metal screen of the power cable 105 and for being firmly secured to the cable 105 itself. Particularly, in order to install the biasing connector 150 on the power cable 105, the cable sheath 137 thereof is firstly cut along the longitudinal direction for a predetermined length; then, the sheath strips obtained through such cuts are opened for exposing the underlying metal screen and for allowing the clamping element 155 to be positioned astride such metal screen. Subsequently, the sheath strips are closed to cover at least a portion of the clamping element 155. In order to increase the stability of the connection between the biasing connector 150 and the power cable 105 once the clamping element 155 has been installed on the metal screen under the cable sheath 137, the sheath strips are then fixed with proper bandages elements 167 and/or by means of a layer of mastic 168 so as to bind the underlying clamping element 155.

The conductive tape 152 has a first end connected (e.g., soldered) to the clamping element 155 and a second end provided with a socket connector 170 adapted to be fastened to the terminal 160 by means of a plug element 175, such as a screw.

A portion of the conductive tape 152 comprising the end connected to the clamping element 155 is covered by the external sheath 144, and extends substantially in parallel to the longitudinal axis 115 following the path of the power cable 105; the other portion, comprising the end provided with the socket connector 170, exits from the external sheath 144 through a corresponding opening 180.

In order to improve the watertightness, the conductive tape 152 may be provided with a protective sheath 185, for example made of a elastomeric material.

FIGS. 2A and 2B illustrate in greater detail the biasing connector 150 according to a first embodiment of the present invention. FIG. 2A and FIG. 2B are a side view and a top view, respectively, of the biasing connector 150; particularly, FIGS. 2A and 2B show the clamping element 155, and a portion of the conductive tape 152 comprising the end connected to the clamping element 155. For the sake of clarity, the biasing connector 150 illustrated in these figures is detached from the power cable 105. The conductive tape 152 has a thickness—identified in FIG. 2A with the reference th—that is substantially lower than the transversal width—identified in FIG. 2B with the reference wd.

According to said embodiment, the conductive tape 152 is made by a solid flat element having a transversal width substantially equal to the transversal width wd, and having a top main surface 202 and a bottom main surface 204 that are substantially smooth. The material forming the conductive tape 152 is a metal having a good conductivity and flexibility, such as copper. An end 206 of the conductive tape 152 is attached to the clamping element 155; for example, the end 206 may be either soldered or braised to a top surface of the clamping element 155. The thickness th and the transversal width wd of the conductive tape 152 depend on the particular electrical application for which the power cables coupled by the joint 100 are intended. Moreover, according to a favorite embodiment of the present invention, the width wd of the conductive tape 152 is set lower than the external diameter of the power cable 105.

According to the proposed solution the connection of the shielding element (i.e. the semiconductive layer 135, the metal screen or both) with the terminal providing the ground voltage is carried out by an element formed by a single flexible flat element having the main surfaces that are substantially smooth. The proposed conductive tape 152 exhibits an improved watertightness compared with the known solutions. Indeed, since the proposed conductive tape 152 is made by a single element free from openings, the infiltrations of water and humidity are reduced; moreover, since the proposed conductive tape 152 has the main surfaces that are substantially smooth, the possible tinning operations directed to plate the material forming the tape may be carried out in a very simplified and effective way.

In order to improve the flexibility of the conductive tape 152 for allowing the latter to better follow the path of the power cable 105 and adhere to the cable sheath 137 thereof, according to an embodiment of the present invention the portion 208 of the conductive tape 152 close to the end 206 is provided with a set of parallel and longitudinal cuts 210.

According to a further embodiment of the present invention, a portion of the conductive tape 152 comprised between the end 206 and the beginning of the protective sheath 185 is provided with protrusion elements 212 projecting from the bottom main surface 204. As already described with reference to FIG. 1, a layer of mastic 168 is provided on the portion of the cable sheath 137 of the cable 105 that is inserted in the joint element 100. The presence of the protrusion elements 212 allows setting a minimum thickness for the layer of mastic 168. Indeed, since the bottom main surface 204 adheres to the layer of mastic 168 when the biasing connector 150 is installed on the power cable 105, the presence of the protrusion elements 212 avoids the layer of mastic 168 to be completely squashed by the bottom main surface 204 in case the conductive tape 152 was applying an excessive pressure to the power cable 105. In the example illustrated in the FIGS. 2A and 2B, the protrusion elements 212 are located on the bottom main surface 204 of the metallic tape 152 to form a triangular arrangement. Similarly, in place of or in addition to the protrusion elements 212 previously described, the conductive tape 152 may be provided with protrusion elements (not shown in the figure) projecting from the top main surface 202.

According to an embodiment of the present invention, the protrusion elements 212 are obtained by locally deforming the conductive tape 152, like it is depicted in the sectional view of FIG. 2C, which is taken along the axis AA' of FIG. 2B. Alternatively, the protrusion elements 212 may be generated by fixing (e.g., soldering) dedicated elements to the bottom main surface 204 of the conductive tape 152.

According to a still further embodiment of the present invention, the clamping element 155 as well is provided with protruding elements 214, which are arranged on the top surface and on the bottom surface thereof in order to obtain a "grater-like" structure adapted to avoid any removal from the cable sheath 137 of the power cable 105 due to accidental traction and to provide a reliable connection between the conductive tape 152 and the power cable 105.

Since the possible infiltrations of water and humidity into the joint 100 typically come from the end of the conductive tape 152 that is not covered by the external sheath 144, it is possible to obtain a watertightness similar to that exhibited by the biasing connector 150 of the embodiments illustrated in FIGS. 2A, 2B and 2C by providing a conductive tape 152 in which a portion thereof including the end connected to the clamping element 155 is formed by a braid of woven metallic wires, while the remaining portion is structured as the conductive tape previously described in FIGS. 2A, 2B and 2C.

Figure 3A:
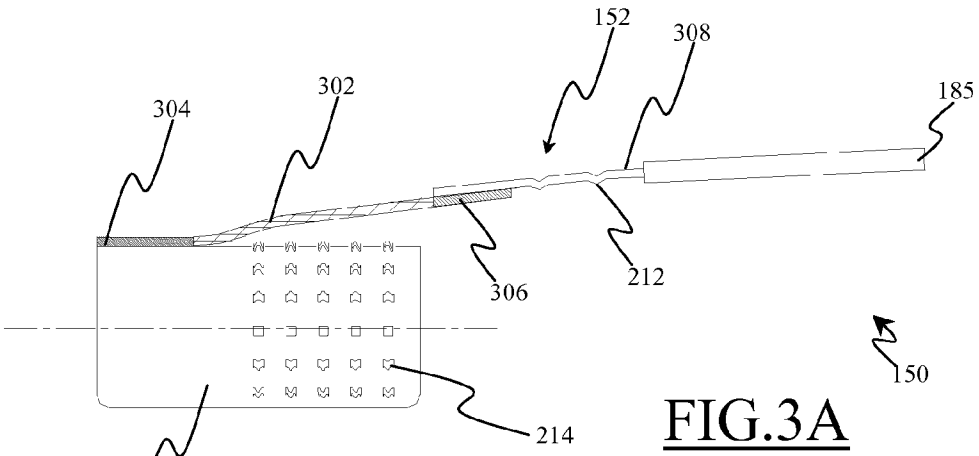
FIG. 3A is a side view of a biasing connector according to a further embodiment of the present invention.
Figure 3B:
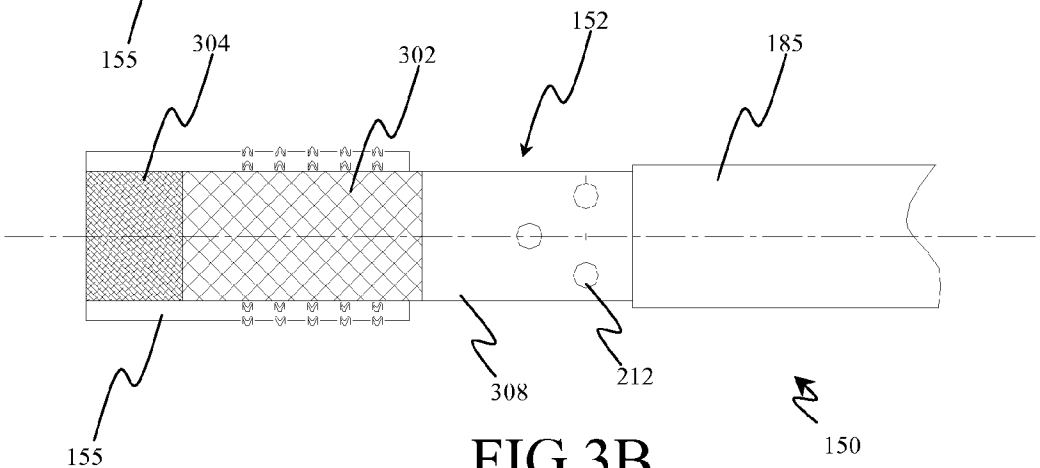
FIG. 3B is a top view of the biasing connector of FIG. 3A.

This alternative solution is depicted in FIGS. 3A and 3B, which correspond to the side view and top view of the biasing connector 150 illustrated in FIGS. 2A and 2B, respectively. Particularly, in this case a first portion—identified with the reference 302—of the conductive tape 152 including a braid of woven metallic wires has a first end 304 connected (e.g., soldered) to the clamping element 155, and a second end 306 connected (e.g., soldered) to a second portion 308 of the conductive tape 152, substantially equal to the conductive tape 152 illustrated in the FIGS. 2A and 2B. In order to prevent the occurrence of water and humidity infiltrations, the second end 306 of the portion 302 is positioned so that it is covered by the layer of mastic 168 and the external sheath 144 when the biasing connector 150 is installed on the power cable 105. Preferably, the biasing connector 150 is configured in such a way that a segment of the second portion 308 as well is covered by the layer of mastic 168 and the external sheath 144 when the biasing connector 150 is installed on the power cable 105 According to this embodiment of the invention, the conductive tape 152 is provided with the high flexibility exhibited by the tapes of the braid type without being affected by any watertightness drawback.

Figure 4A:
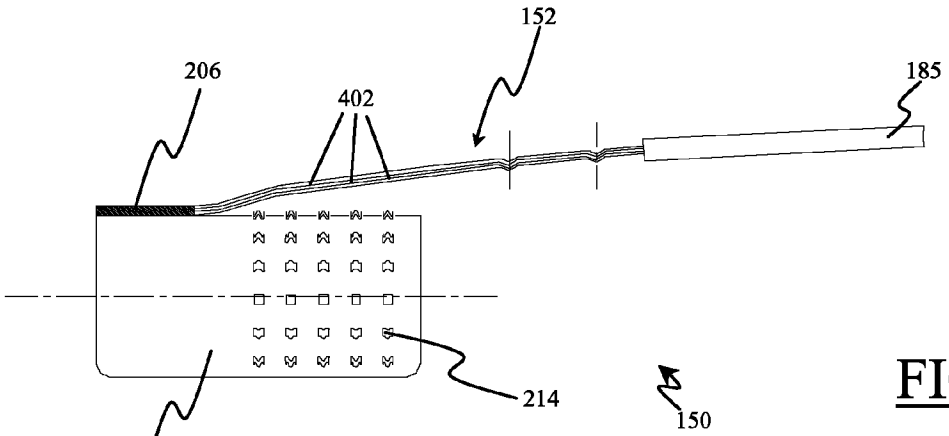
FIG. 4A is a side view of a biasing connector according to a still further embodiment of the present invention.
Figure 4B:
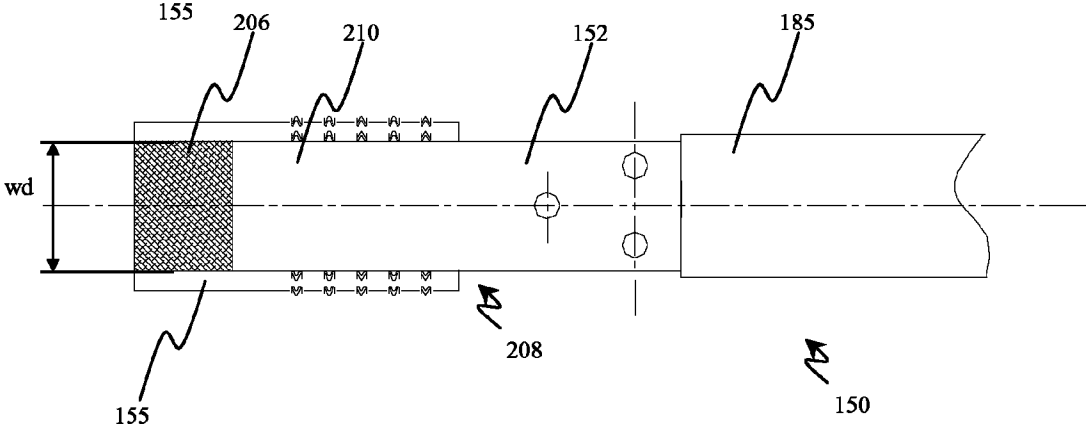
FIG. 4B is a top view of the biasing connector of FIG. 4A.

In order to increase the flexibility of the conductive tape 152, according to a further embodiment of the present invention—illustrated in the FIGS. 4A and 4B—, the conductive tape 152 is formed by a plurality of overlapping layers 402, each formed by a corresponding solid flat element having a transversal width substantially equal to the transversal width wd and a top main surface and a bottom main surface that are substantially smooth. Particularly, FIG. 4A and FIG. 4B are a side view and a top view, respectively, of the biasing connector 150 provided with such multi-layered conductive tape 152.

In order to avoid any infiltration of water and/or humidity within the space between two adjacent layers 402, all the layers 402 are provided with plugging elements (not shown in the figure) formed by means of soldering or hotmelting. Advantageously, in each layer 402, such plugging elements are located in the same position with respect to the length of the whole conductive tape 152; moreover, the plugging elements are positioned along the layers 402 so that they are covered by the layer of mastic 168 and the external sheath 144 when the biasing connector 150 is installed on the power cable 105.

According to an alternative embodiment of the present invention, the end portion of the biasing connector 150 which is adapted to contact the metal screen of the power cable 105 is integral to the conductive tape 152. Unlike the previously described clamping element 155, which is configured to mechanically cooperate with the outer surface of the semiconductive layer 135 and the metal screen by applying a radial tightening when located astride the semiconductive layer 135 and the metal screen, according to such embodiment of the present invention, the end portion of the biasing connector 150 is fastened to the semiconductive layer and/or the metal screen of the power cable 105 by means of a fastening element.

Figure 5:
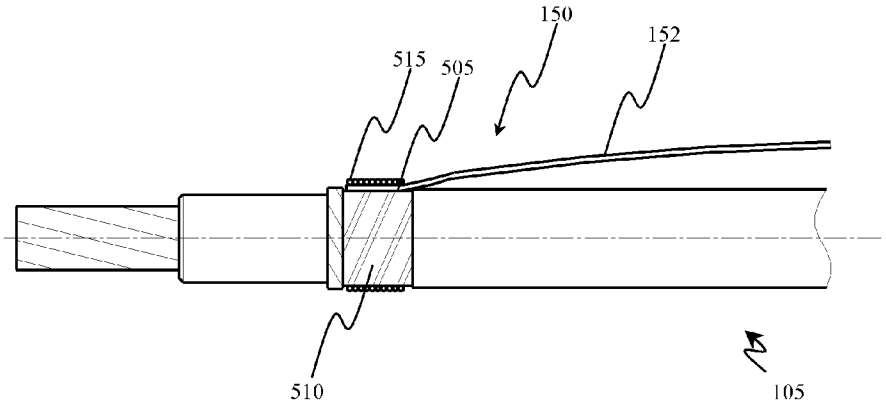
FIG. 5 is a side view of a biasing connector according to an alternative embodiment of the present invention.

For example, in the embodiment of the invention illustrated in FIG. 5, the end portion is a terminal portion of the conductive tape 152—identified in the figure with the reference 505—which contacts the metal screen of the power cable 105—identified in the figure with the reference 510. According to this embodiment, the end portion 505 is bonded to the metal screen 510 by means of a metallic wire 515, e.g. made of tinned copper.

Figure 6:
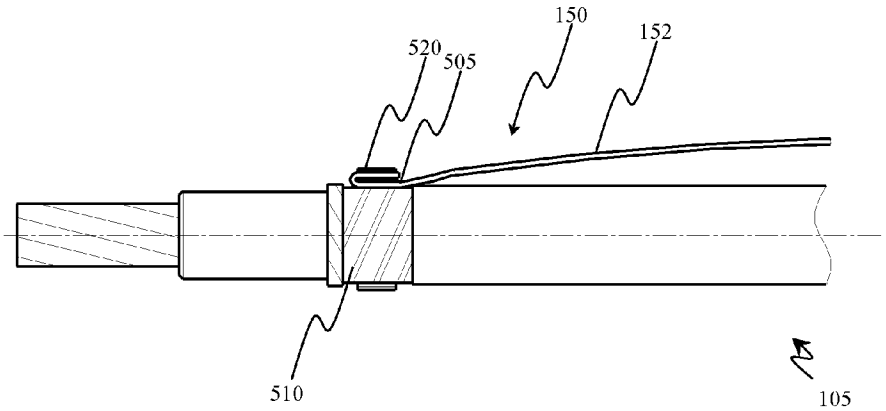
FIG. 6 is a side view of a biasing connector according to a further alternative embodiment of the present invention.

According to a further embodiment of the present invention illustrated in FIG. 6, the end portion 505 is inserted into a spring element 520 configured to exert a fastening effect to the metal screen 510 when installed on the power cable 105. In the embodiment illustrated in FIG. 6 the end portion 505 inserted in the spring element 520 is properly bended so as to avoid any removal of the conductive tape 152 from the spring element 520 due to accidental tractions.

According to a still further embodiment (not illustrated) of the present invention, the end portion of the biasing connector 150 is directly soldered to the metal screen of the power cable 105.

Naturally, in order to satisfy local and specific requirements, a person skilled in the art may apply to the solution described above many modifications and alterations. Particularly, although the present invention has been described with a certain degree of particularity with reference to preferred embodiment(s) thereof, it should be understood that various omissions, substitutions and changes in the form and details as well as other embodiments are possible; moreover, it is expressly intended that specific elements and/or method steps described in connection with any disclosed embodiment of the invention may be incorporated in any other embodiment as a general matter of design choice.

For example, in other embodiments of the invention, the conductive tape may include, in addition to or in alternative to the portion made of a braid of woven wires, another portion also made of a braid of woven wires, near the socket connector 170.

Furthermore, even if reference has been made to a biasing connector adapted to ground the joint shield of a joint element, the concepts of the present invention can be applied to a biasing connector adapted to directly ground the shielding elements of the power cables connected to such joint.

Moreover, the concepts of the present invention can be also applied to biasing connectors adapted to be installed on power cables in different power cable connection accessories, such as separable MV cable connectors, MV cable terminations, branch MV cable joints, stop-ends and the like.

Even if reference has been made to a biasing connector whose clamping element is configured to be positioned astride a portion of the exposed semiconductive layer and a portion of the metal screen of the power cable, similar considerations apply in case such clamping element is only positioned astride the metal screen of the power cable or only positioned astride the semiconductive layer. The biasing connector can be applied to a power cable wherein only a semiconductive layer or a metal screen is present.

Even if reference has been made to power cables for medium voltage applications, similar considerations apply to power cables designed for operating within different voltage ranges, such as the ones corresponding to low and high voltage applications.

The invention claimed is:

1. A biasing connector for biasing a shielding element of a power cable in connection with a cable joint, wherein an external sheath extends over a length of a cable sheath, the biasing connector comprising:

an end portion configured to contact the shielding element; and a conductive tape having a first end, connected to the end portion of the biasing connector, and a second end, configured to connect to a terminal providing a biasing voltage;

wherein at least one portion of the conductive tape comprises at least one layer of a solid flat element having a width substantially equal to a transversal width of the conductive tape, wherein the at least one portion of the conductive tape is at least partly covered by the external sheath, wherein the end portion comprises a clamping element including a warped sheet of metallic material configured to mechanically cooperate with the shielding element, and wherein the clamping element is a laterally opened tubular element.

2. The biasing connector of claim 1, wherein a protective sheath covers at least part of the conductive tape.

3. The biasing connector of claim 1, wherein the at least one portion of the conductive tape comprising the at least one layer of a solid flat element includes the second end.

4. The biasing connector of claim 1, wherein the at least one portion of the conductive tape comprising the at least one layer of a solid flat element includes the first end.

5. The biasing connector of claim 4, wherein the conductive tape is provided with a set of longitudinal cuts in a proximity of the first end.

6. The biasing connector of claim 1, wherein the conductive tape includes a first braid-of-woven-wires portion connected to the end portion of the biasing connector.

7. The biasing connector of claim 1, wherein the conductive tape includes a second braid-of-woven-wires portion connected between the at least one layer of a solid flat element and the second end.

8. The biasing connector of claim 1, wherein the at least one portion of the conductive tape is made of copper.

9. The biasing connector of claim 1, wherein the at least one portion of the conductive tape is made of tinned copper.

10. The biasing connector of claim 1, wherein the warped sheet comprises a plurality of protruding elements.

11. The biasing connector of claim 1, wherein the end portion is a portion integral to the conductive tape configured to fasten to the shielding element using a fastening element.

12. The biasing connector of claim 11, wherein the fastening element comprises:

a metallic wire;

a spring element; or a soldering.

13. The biasing connector of claim 1, wherein the second end includes a socket connector configured to connect to the terminal using a plug element.

14. A power cable connection assembly, comprising:

a biasing connector configured to couple to a shielding element of a power cable, the biasing connector comprising:

an end portion configured to contact the shielding element; and a conductive tape having a first end, connected to the end portion of the biasing connector, and a second end, configured to connect to a terminal providing a biasing voltage; and an external sheath extending over a length of a cable sheath;

wherein at least one portion of the conductive tape comprises at least one layer of a solid flat element having a width substantially equal to a transversal width of the conductive tape, wherein the at least one portion of the conductive tape is at least partly covered by the external sheath, wherein the end portion comprises a clamping element including a warped sheet of metallic material configured to mechanically cooperate with the shielding element, and wherein the clamping element is a laterally opened tubular element.

15. A biasing connector for biasing a shielding element of a power cable in connection with a cable joint, wherein an external sheath extends over a length of a cable sheath, the biasing connector comprising:

an end portion configured to contact the shielding element; and a conductive tape having a first end, connected to the end portion of the biasing connector, and a second end, configured to connect to a terminal providing a biasing voltage;

wherein at least one portion of the conductive tape comprises at least one layer of a solid flat element having a width substantially equal to a transversal width of the conductive tape, wherein the at least one portion of the conductive tape is at least partly covered by the external sheath, wherein each at least one layer of a solid flat element includes a top main surface and a bottom main surface that are substantially smooth, and wherein each at least one layer of a solid flat element includes:

at least one protrusion projecting from the bottom main surface; or at least one protrusion projecting from the top main surface.

16. The biasing connector of claim 15, wherein each at least one layer of a solid flat element includes:

at least one protrusion projecting from the bottom main surface; and at least one protrusion projecting from the top main surface.

17. The biasing connector of claim 15, wherein a protective sheath covers at least part of the conductive tape.

18. The biasing connector of claim 15, wherein the at least one portion of the conductive tape comprising the at least one layer of a solid flat element includes the second end.

19. The biasing connector of claim 15, wherein the at least one portion of the conductive tape comprising the at least one layer of a solid flat element includes the first end.

20. The biasing connector of claim 15, wherein the conductive tape includes a first braid-of-woven-wires portion connected to the end portion of the biasing connector.

* * * * *